US011187064B2

(12) United States Patent
Thomas et al.

(10) Patent No.: US 11,187,064 B2
(45) Date of Patent: Nov. 30, 2021

(54) WELL PUMPING SYSTEM WITH ENCLOSED ROD ROTATOR

(71) Applicant: WEATHERFORD TECHNOLOGY HOLDINGS, LLC, Houston, TX (US)

(72) Inventors: Benson Thomas, Pearland, TX (US); Patricia L. Vines, Fort Worth, TX (US); Clark E. Robison, Tomball, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 1523 days.

(21) Appl. No.: 14/947,919

(22) Filed: Nov. 20, 2015

(65) Prior Publication Data

US 2017/0145799 A1 May 25, 2017

(51) Int. Cl.
*E21B 43/12* (2006.01)
*E21B 47/008* (2012.01)
*E21B 33/06* (2006.01)

(52) U.S. Cl.
CPC ..... *E21B 43/126* (2013.01); *E21B 47/008* (2020.05); *E21B 33/06* (2013.01)

(58) Field of Classification Search
CPC ..... E21B 43/126; E21B 47/0007; E21B 33/06
USPC ..... 166/250.15
See application file for complete search history.

(56) References Cited

U.S. PATENT DOCUMENTS 2,932,204 A 4/1960 Elves et al.
3,030,935 A 4/1962 Hanes
5,351,583 A 10/1994 Szymber et al.
5,865,245 A * 2/1999 Trout ..... E21B 33/08 166/177.3
6,155,792 A 12/2000 Hartley et al.
7,857,043 B2 12/2010 Ali-Zada et al.
9,140,113 B2 * 9/2015 Hurst ..... E21B 47/0008
2004/0011532 A1 * 1/2004 White ..... E21B 17/1071 166/381
2004/0140087 A1 7/2004 Ferguson et al.
2007/0159161 A1 * 7/2007 Neill ..... F15B 15/28 340/539.22

(Continued)

OTHER PUBLICATIONS

Office Action dated Dec. 12, 2017 for U.S. Appl. No. 14/964,913, 21 pages.

(Continued)

*Primary Examiner* — Matthew Troutman
*Assistant Examiner* — Patrick F Lambe
(74) *Attorney, Agent, or Firm* — Smith IP Services, P.C.

(57) ABSTRACT

A well pumping system can include a rod rotator including a torque transfer device, an outer housing and a rotary actuator. The rotary actuator rotates the torque transfer device and a rod relative to the outer housing. The rod reciprocably displaces longitudinally relative to the outer housing. A method of rotating a rod string can include applying a torque from a torque transfer device to a rod connected to the rod string, the torque being maintained in the rod as the rod displaces relative to an outer housing. The torque transfer device is fully enclosed within the outer housing during the torque applying step. Another well pumping system can include a rod rotator with an outer housing connected between a stuffing box and a blowout preventer. The rod rotator rotates a rod string in a well.

25 Claims, 8 Drawing Sheets

(56) References Cited

U.S. PATENT DOCUMENTS

| | | | |
|---|---|---|---|
| 2010/0212882 | A1 | 8/2010 | Guven et al. |
| 2016/0010640 | A1 | 1/2016 | Tetzlaff et al. |

OTHER PUBLICATIONS

Weatherford; "Intelligent Rod Rotator", company article 10866.00, dated 2013, 8 pages.
Office Action dated Jun. 13, 2019 for U.S. Appl. No. 14/964,913, 15 pages.
Office Action dated Sep. 13, 2019 for U.S. Appl. No. 15/698,571, 34 pages.
Office Action dated Apr. 28, 2021 for U.S. Appl. No. 15/698,571, 17 pages.
Office Action dated Oct. 27, 2020 for U.S. Appl. No. 15/698,571, 19 pages.

* cited by examiner

WELL PUMPING SYSTEM WITH ENCLOSED ROD ROTATOR

BACKGROUND

This disclosure relates generally to equipment utilized and operations performed in conjunction with a subterranean well and, in one example described below, more particularly provides a well pumping system and associated method.

Reservoir fluids can sometimes flow to the earth's surface when a well has been completed. However, with some wells, reservoir pressure may be insufficient (at the time of well completion or thereafter) to lift the fluids (in particular, liquids) to the surface. In those circumstances, technology known as "artificial lift" can be employed to bring the fluids to or near the surface (such as a subsea production facility or pipeline, a floating rig, etc.).

Various types of artificial lift technology are known to those skilled in the art. In one type of artificial lift, a downhole pump is operated by reciprocating a string of "sucker" rods deployed in a well. An apparatus (such as, a walking beam-type pump jack or a hydraulic actuator) located at the surface can be used to reciprocate the rod string.

Therefore, it will be readily appreciated that improvements are continually needed in the arts of constructing and operating artificial lift systems. Such improvements may be useful for lifting oil, water, gas condensate or other liquids from wells, may be useful with various types of wells (such as, gas production wells, oil production wells, water or steam flooded oil wells, geothermal wells, etc.), and may be useful for any other application where reciprocating motion is desired.

DETAILED DESCRIPTION

Figure 1:
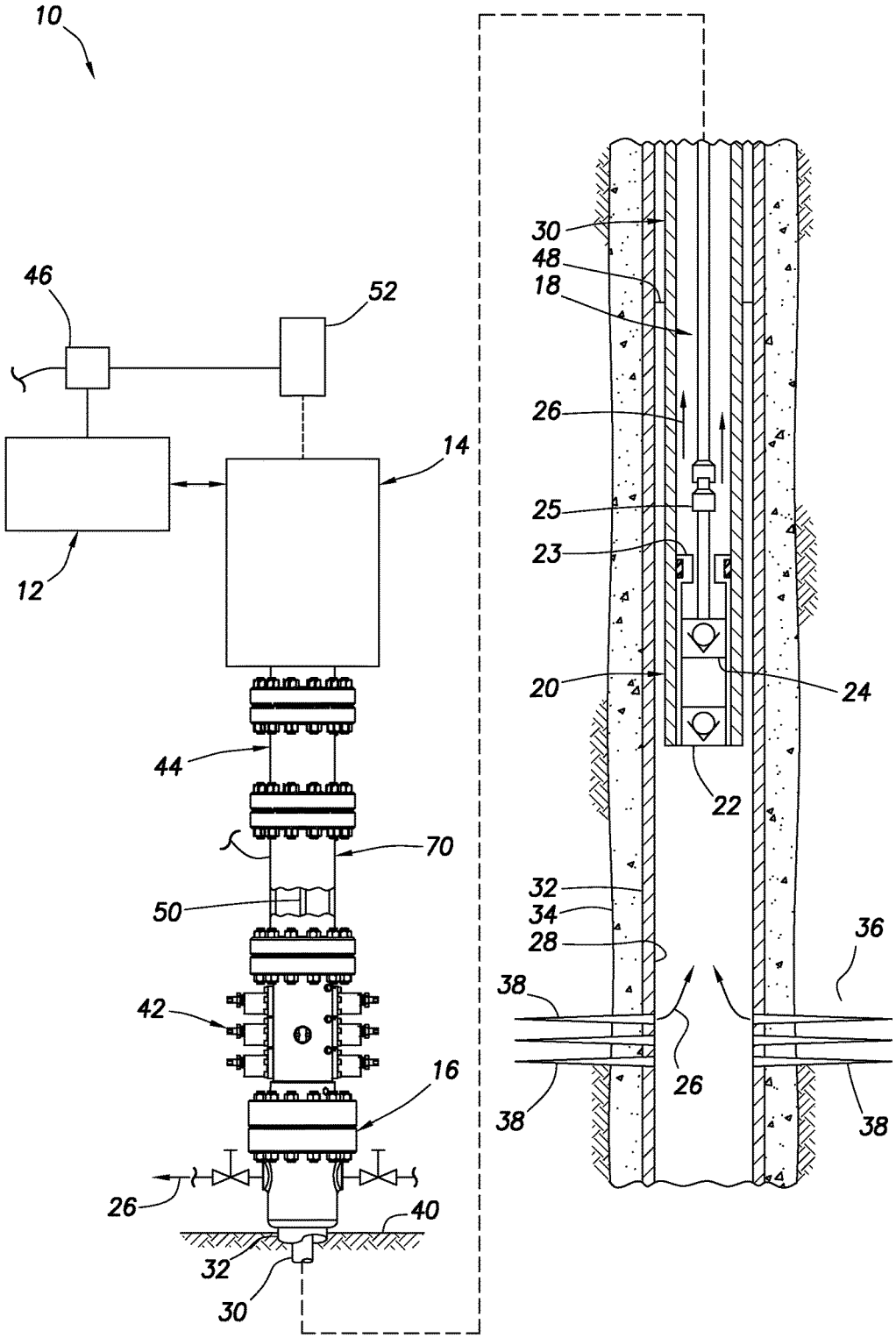
FIG. 1 is a representative partially cross-sectional view of an example of a well pumping system and associated method which can embody principles of this disclosure.

Representatively illustrated in FIG. 1 is a well pumping system 10 and associated method for use with a subterranean well, which system and method can embody principles of this disclosure. However, it should be clearly understood that the well pumping system 10 and method are merely one example of an application of the principles of this disclosure in practice, and a wide variety of other examples are possible. Therefore, the scope of this disclosure is not limited at all to the details of the system 10 and method as described herein or depicted in the drawings.

In the FIG. 1 example, a power source 12 is used to supply energy to an actuator 14 mounted on a wellhead 16. In response, the actuator 14 reciprocates a rod string 18 extending into the well, thereby operating a downhole pump 20.

The rod string 18 may be made up of individual sucker rods connected to each other, although other types of rods or tubes may be used, the rod string 18 may be continuous or segmented, a material of the rod string 18 may comprise steel, composites or other materials, and elements other than rods may be included in the string. Thus, the scope of this disclosure is not limited to use of any particular type of rod string, or to use of a rod string at all. It is only necessary for purposes of this disclosure to communicate reciprocating motion of the actuator 14 to the downhole pump 20, and it is therefore within the scope of this disclosure to use any structure capable of such transmission.

The downhole pump 20 is depicted in FIG. 1 as being of the type having a stationary or "standing" valve 22 and a reciprocating or "traveling" valve 24. The traveling valve 24 is connected to, and reciprocates with, the rod string 18, so that fluid 26 is pumped from a wellbore 28 into a production tubing string 30. However, it should be clearly understood that the downhole pump 20 is merely one example of a wide variety of different types of pumps that may be used with the well pumping system 10 and method of FIG. 1, and so the scope of this disclosure is not limited to any of the details of the downhole pump described herein or depicted in the drawings.

The wellbore 28 is depicted in FIG. 1 as being generally vertical, and as being lined with casing 32 and cement 34. In other examples, a section of the wellbore 28 in which the pump 20 is disposed may be generally horizontal or otherwise inclined at any angle relative to vertical, and the wellbore section may not be cased or may not be cemented. Thus, the scope of this disclosure is not limited to use of the well pumping system 10 and method with any particular wellbore configuration.

In the FIG. 1 example, the fluid 26 originates from an earth formation 36 penetrated by the wellbore 28. The fluid 26 flows into the wellbore 28 via perforations 38 extending through the casing 32 and cement 34. The fluid 26 can be a liquid, such as oil, gas condensate, water, etc. However, the scope of this disclosure is not limited to use of the well pumping system 10 and method with any particular type of fluid, or to any particular origin of the fluid.

As depicted in FIG. 1, the casing 32 and the production tubing string 30 extend upward to the wellhead 16 at or near the earth's surface 40 (such as, at a land-based wellsite, a subsea production facility, a floating rig, etc.). The production tubing string 30 can be hung off in the wellhead 16, for example, using a tubing hanger (not shown). Although only a single string of the casing 32 is illustrated in FIG. 1 for clarity, in practice multiple casing strings and optionally one or more liner strings (a liner string being a pipe that extends from a selected depth in the wellbore 28 to a shallower depth, typically sealingly "hung off" inside another pipe or casing) may be installed in the well.

In the FIG. 1 example, a rod blowout preventer stack 42 and a stuffing box 44 are connected between the actuator 14 and the wellhead 16. The rod blowout preventer stack 42 includes various types of blowout preventers (BOP's) configured for use with the rod string 18. For example, one blowout preventer can prevent flow through the blowout preventer stack 42 when the rod string 18 is not present therein, and another blowout preventer can prevent flow through the blowout preventer stack 42 when the rod string 18 is present therein. However, the scope of this disclosure is not limited to use of any particular type or configuration of blowout preventer stack with the well pumping system 10 and method of FIG. 1.

The stuffing box 44 includes an annular seal (not visible in FIG. 1) about an upper end of the rod string 18. A reciprocating rod 50 forms an upper section of the rod string 18 below the annular seal, although in other examples a connection between the rod 50 and the rod string 18 may be otherwise positioned.

In some examples, a rod of the type known to those skilled in the art as a "polished rod" suitable for sliding and sealing engagement within the annular seal in the stuffing box 44 may be connected above the rod 50. The polished rod may be a component of the actuator 14, such as, a rod extending downwardly from a piston of the actuator (see FIG. 2).

The power source 12 may be connected directly to the actuator 14, or it may be positioned remotely from the actuator 14 and connected with, for example, suitable electrical cables, mechanical linkages, hydraulic hoses or pipes. Operation of the power source 12 is controlled by a control system 46.

The control system 46 may allow for manual or automatic operation of the actuator 14 via the power source 12, based on operator inputs and measurements taken by various sensors. The control system 46 may be separate from, or incorporated into, the actuator 14 or the power source 12. In one example, at least part of the control system 46 could be remotely located or web-based, with two-way communication between the actuator 14, the power source 12 and the control system 46 being via, for example, satellite, wireless or wired transmission.

The control system 46 can include various components, such as a programmable controller, input devices (e.g., a keyboard, a touchpad, a data port, etc.), output devices (e.g., a monitor, a printer, a recorder, a data port, indicator lights, alert or alarm devices, etc.), a processor, software (e.g., an automation program, customized programs or routines, etc.) or any other components suitable for use in controlling operation of the actuator 14 and the power source 12. The scope of this disclosure is not limited to any particular type or configuration of a control system.

In operation of the well pumping system 10 of FIG. 1, the control system 46 causes the power source 12 to increase energy input to the actuator 14, in order to raise the rod string 18. Conversely, the energy input to the actuator 14 is reduced or removed, in order to allow the rod string 18 to descend. Thus, by alternately increasing and decreasing energy input to the actuator 14, the rod string 18 is reciprocated, the downhole pump 20 is actuated and the fluid 26 is pumped out of the well.

It can be advantageous to control a reciprocation speed of the rod string 18, instead of reciprocating the rod string as fast as possible. For example, a fluid interface 48 in the wellbore 28 can be affected by the flow rate of the fluid 26 from the well. The fluid interface 48 could be an interface between oil and water, gas and water, gas and gas condensate, gas and oil, steam and water, or any other fluids or combination of fluids.

If the flow rate is too great, the fluid interface 48 may descend in the wellbore 28, so that eventually the pump 20 will no longer be able to pump the fluid 26 (a condition known to those skilled in the art as "pump-off"). On the other hand, it is typically desirable for the flow rate of the fluid 26 to be at a maximum level that does not result in pump-off. In addition, a desired flow rate of the fluid 26 may change over time (for example, due to depletion of a reservoir, changed offset well conditions, water or steam flooding characteristics, etc.).

A "gas-locked" downhole pump 20 can result from a pump-off condition, whereby gas is received into the downhole pump 20. The gas is alternately expanded and compressed in the downhole pump 20 as the traveling valve 24 reciprocates, but the fluid 26 cannot flow into the downhole pump 20, due to the gas therein.

In the FIG. 1 well pumping system 10 and method, the control system 46 can automatically control operation of the actuator 14 via the power source 12 to regulate the reciprocation speed, so that pump-off is avoided, while achieving any of various desirable objectives. Those objectives may include maximum flow rate of the fluid 26, optimized rate of electrical power consumption, reduction of peak electrical loading, etc. However, it should be clearly understood that the scope of this disclosure is not limited to pursuing or achieving any particular objective or combination of objectives via automatic reciprocation speed regulation by the control system 46.

As mentioned above, the power source 12 is used to variably supply energy to the actuator 14, so that the rod string 18 is displaced alternately to its upper and lower stroke extents. These extents do not necessarily correspond to maximum possible upper and lower displacement limits of the rod string 18 or the pump 20.

For example, it is typically undesirable for a valve rod bushing 25 above the traveling valve 24 to impact a valve rod guide 23 above the standing valve 22 when the rod string 18 displaces downward (a condition known to those skilled in the art as "pump-pound"). Thus, it is preferred that the rod string 18 be displaced downward only until the valve rod bushing 25 is near its maximum possible lower displacement limit, so that it does not impact the valve rod guide 23.

On the other hand, the longer the stroke distance (without impact), the greater the productivity and efficiency of the pumping operation (within practical limits), and the greater the compression of fluid between the standing and traveling valves 22, 24 (e.g., to avoid gas-lock). In addition, a desired stroke of the rod string 18 may change over time (for example, due to gradual lengthening of the rod string 18 as a result of lowering of a liquid level (such as at fluid interface 48) in the well, etc.).

In the FIG. 1 well pumping system 10 and method, the control system 46 can automatically control operation of the power source 12 to regulate the upper and lower stroke extents of the rod string 18, so that pump-pound is avoided, while achieving any of various desirable objectives. Those objectives may include maximizing rod string 18 stroke length, maximizing production, minimizing electrical power consumption rate, minimizing peak electrical loading, etc. However, it should be clearly understood that the scope of this disclosure is not limited to pursuing or achieving any particular objective or combination of objectives via automatic stroke extent regulation by the control system 46.

In the FIG. 1 example, the system 10 includes a continuous position sensor 52 in communication with the control system 46. The continuous position sensor 52 is capable of continuously detecting a position of a reciprocating member at or near the surface 40 (such as, the piston or piston rod of the actuator 14 (see FIG. 2), the rod 50 or another member).

An output of the continuous position sensor 52 can be useful to achieve a variety of objectives, such as, controlling stroke distance, speed and extents to maximize production and efficiency, minimize electrical power consumption and/or peak electrical loading, maximize useful life of the rod string 18, etc. However, the scope of this disclosure is not limited to pursuing or achieving any particular objective or combination of objectives via use of a continuous position sensor.

As used herein, the term "continuous" is used to refer to a substantially uninterrupted sensing of position by the sensor 52. For example, when used to continuously detect the position of the rod 50, the sensor 52 can detect the rod's position during all portions of its reciprocating motion, and not just at certain discrete points (such as, at the upper and lower stroke extents). However, a continuous position sensor may have a particular resolution (e.g., 0.001-0.1 mm) at which it can detect the position of a member. Accordingly, the term "continuous" does not require an infinitely small resolution.

Using the continuous position sensor 52, the control system 46 can be provided with an accurate measurement of a reciprocating member position at any point in the member's reciprocation, thereby dispensing with any need to perform calculations based on discrete detections of position. It will be appreciated by those skilled in the art that actual continuous position detection can be more precise than such calculations of position, since various factors (including known and unknown factors, such as, temperature, fluid compressibility, fluid leakage, etc.) can affect the calculations.

By continuously sensing the position of a reciprocating member at or near a top of the rod string 18, characteristics of the rod string's reciprocating displacement are communicated to the control system 46 at each point in the rod string's reciprocating displacement. The control system 46 can, thus, determine whether the rod string's 18 position, speed and acceleration correspond to desired preselected values.

If there is a discrepancy between the desired preselected values and the rod string's reciprocating displacement as detected by the sensor 52, the control system 46 can change how energy is supplied to the actuator 14 by the power source 12, so that the reciprocating displacement will conform to the desired preselected values. For example, the control system 46 may change a level, timing, frequency, duration, etc., of the energy input to the actuator 14, in order to change the rod string's upper or lower stroke extent, or velocity or acceleration at any point in the rod string's reciprocating displacement.

Note that the desired preselected values may change over time. As mentioned above, it may be desirable to change the upper or lower stroke extent, or the pumping rate, during the pumping operation, for example, due to the level of the fluid interface 48 changing, reservoir depletion over time, detection of a pump-off, pump-pound or gas-lock condition, etc.

Although the continuous position sensor 52 provides certain benefits in the system 10 and method example of FIG. 1, it should be clearly understood that it is not necessary in keeping with the scope of this disclosure for a continuous position sensor or any other particular type of sensor to be used.

It can be advantageous to rotate the rod string 18 during the pumping operation, for example, to more evenly distribute wear on the rod string. As mentioned above, the rod string 18 may extend through deviated or horizontal sections of the wellbore 28, and can rub against an inner surface of the tubing string 30 in those sections.

For this reason and others, the system 10 includes a rod rotator 70 connected between the stuffing box 44 and the blowout preventer stack 42. In other examples, the rod rotator 70 could be incorporated into either of the stuffing box 44 or the blowout preventer stack 42, or could be otherwise located, and so the scope of this disclosure is not limited to any particular placement or configuration of the rod rotator.

The rod rotator 70 in the FIG. 1 example is connected to the control system 46. In this manner, rotation of the rod 50 (and the rod string 18) can be effectively coordinated with the reciprocating displacement. Because the position sensor 52 provides the control system 46 with a continuous position output for the reciprocating displacement, operation of the rod rotator can be more effectively controlled by the control system, as described more fully below.

Figure 2:
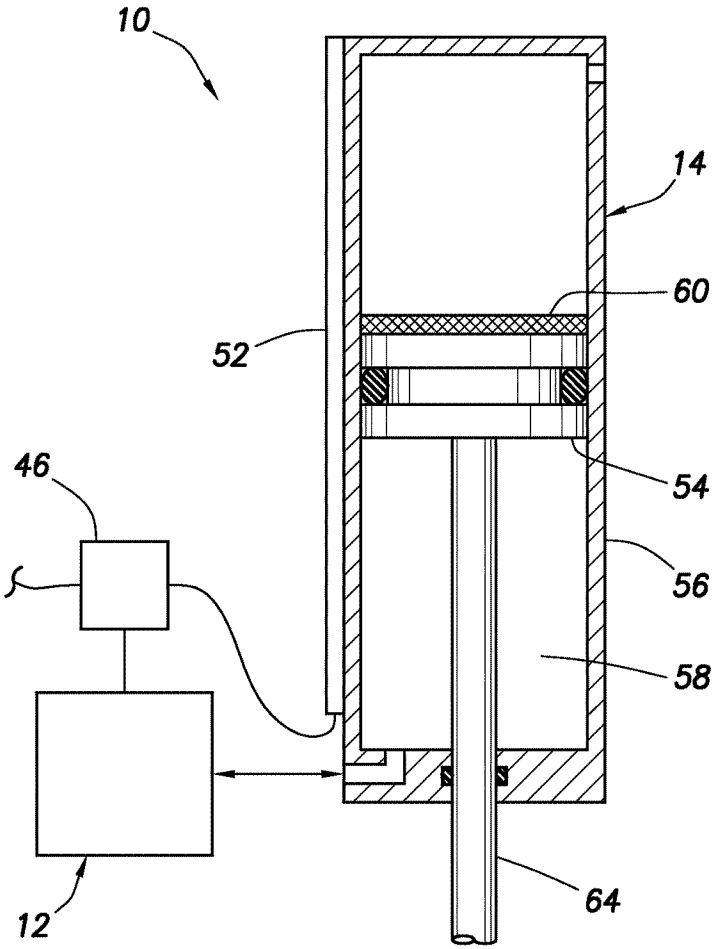
FIG. 2 is a representative partially cross-sectional view of an actuator that may be used with the system and method of FIG. 1.

Referring additionally now to FIG. 2, an example of the actuator 14 that may be used with the system 10 and method is representatively illustrated. The actuator 14 in this example is a single-acting hydraulic actuator, but other types of actuators may be used (such as, mechanical, electrical, double-acting hydraulic, accumulator-balanced hydraulic, etc.). Thus, the scope of this disclosure is not limited to use of any particular type of actuator.

In the FIG. 2 example, the actuator 14 includes a piston 54 sealingly and reciprocably disposed in a generally cylindrical housing 56. A piston rod 64 is connected to the piston 54 and extends downwardly through a lower end of the housing 56. The piston rod 64 may be connected to the rod 50 (such as, below the annular seal in the stuffing box 44), or in some examples they may be a single member.

The power source 12 in this example comprises a hydraulic pressure source (such as, a hydraulic pump and associated equipment) for supplying energy in the form of fluid pressure to a chamber 58 in the housing 56 below the piston 54. To raise the piston 54, the piston rod 64, the rod 50 and the rod string 18, hydraulic fluid at increased pressure is supplied to the chamber 58 from the power source 12. To cause the piston 54, piston rod 64, rod 50 and rod string 18 to descend, the pressure in the chamber 58 is reduced (with hydraulic fluid being returned from the chamber to the power source 12).

In this example, the sensor 52 is attached externally to the housing 56. In other examples, the sensor 52 could be positioned internal to (or in a wall of) the housing 56, or the sensor 52 could be associated with the rod rotator 70 to continuously detect a position of the rod 50 as it reciprocates. Thus, the scope of this disclosure is not limited to any particular position or orientation of the sensor 52.

A magnet 60 is attached to, and displaces with, the piston 54. A position of the magnet 60 (and, thus, of the piston 54) is continuously sensed by the sensor 52 during reciprocating displacement of the piston. A suitable magnet for use in the actuator 14 is a neodymium magnet (such as, a neodymium-iron-boron magnet) in ring form. However, other types and shapes of magnets may be used in keeping with the principles of this disclosure.

In other examples, the magnet 60 could be attached to, and displace with the rod 50 or another component of the rod rotator 70. The scope of this disclosure is not limited to any particular position of the magnet 60, or detection of the position of any particular component of the actuator 14 or rod rotator 70.

A suitable linear position sensor (or linear variable displacement transducer) for use as the sensor 52 in the system 10 is available from Rota Engineering Ltd. of Manchester, United Kingdom. Other suitable position sensors are available from Hans Turck GmbH & Co. KG of Germany, and from Balluff GmbH of Germany. However, the scope of this disclosure is not limited to use of any particular sensor with the system 10.

Figure 3:
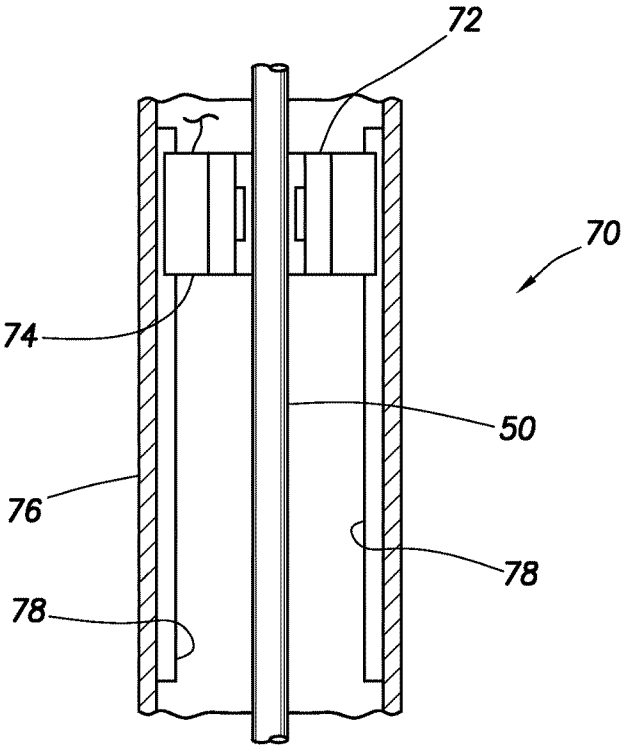
FIGS. 3-5 are representative partially cross-sectional views of operational configurations of a rod rotator that may be used with the system and method of FIG. 1.
Figure 5:
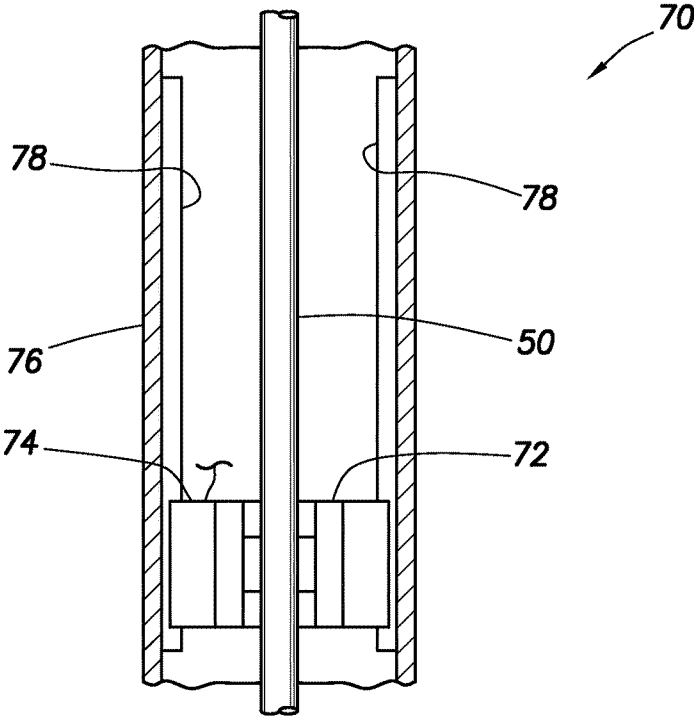
Figure 4:
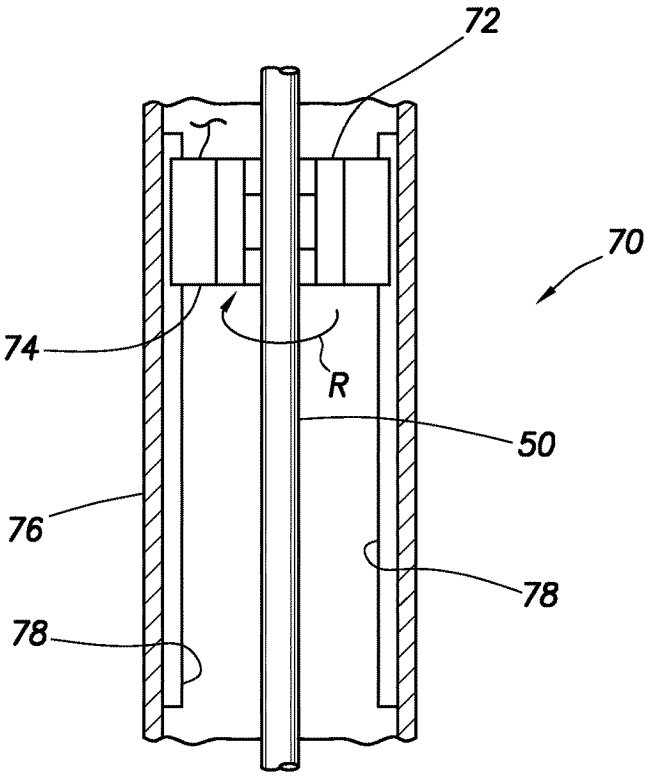

Referring additionally now to FIGS. 3-5, partially cross-sectional views of one example of the rod rotator 70 are representatively illustrated in operation. The rod rotator 70 may be used with the system 10 and method of FIG. 1, or it may be used with other systems and methods.

In the FIG. 3 example, the rod rotator 70 grips and applies a torque and rotation to the rod 50 just prior to, or at a beginning of, a downward stroke of the rod. The torque and rotation are maintained as the rod 50 strokes downward, thereby causing the entire rod string 18 to rotate in the well. This allows for the fact that rotation of the rod 50 at an upper end of the rod string 18 may not initially result in a corresponding rotation of the rod string at its lower end in the well, but if the rotation of the rod 50 is maintained as the rod strokes downward, more (if not all) of the rotation will be translated to the lower end of the rod string 18 by the time the rod 50 reaches a bottom of its downward stroke.

As depicted in FIGS. 3-5, the rod rotator 70 includes a torque transfer device 72 and a rotary actuator 74. In this example, the torque transfer device 72 and rotary actuator 74 are longitudinally displaceable with the rod 50 relative to an outer generally tubular housing 76. For example, slots or tracks 78 could be provided in the housing 76 for sliding engagement with the torque transfer device 72 and rotary actuator 74.

In other examples described below, the rod rotator 70 does not include a torque transfer device, or a rotary actuator, that displaces longitudinally with the rod 50. Therefore, it should be clearly understood that the scope of this disclosure is not limited to any particular details of the construction or operation of the rod rotator 70 as described herein or depicted in the drawings.

In FIG. 3, the rod rotator 70 is depicted prior to a downward stroke of the rod 50. The torque transfer device 72 and rotary actuator 74 are positioned at an upper end of the outer housing 76. The control system 46 (see FIGS. 1 & 2) is connected to the torque transfer device 72 and rotary actuator 74, so that their operation can be coordinated with the reciprocating displacement of the rod 50 as indicated by the continuous position sensor 52.

In FIG. 4, the control system 46 has operated the torque transfer device 72 to grip an outer surface of the rod 50. In addition, the control system 46 has operated the rotary actuator 74 to rotate the rod 50 after the torque transfer device 72 grips the rod. Rotation and torque delivered to the rod 50 are indicated by the arrow R in FIG. 4.

In FIG. 5, the rod rotator 70 is depicted with the rod 50 at a bottom of its downward stroke. The torque transfer device 72 remains grippingly engaged with the rod 50.

At this point, it is contemplated that all, or substantially all, of the rod 50 rotation R (see FIG. 4) will have been translated through the rod string 18 in the well, and so the torque transfer device 72 can be released in preparation for returning to the FIG. 3 position. The torque transfer device 72 and rotary actuator 74 return to the FIG. 3 position with an upward stroke of the rod 50.

In some examples, the rotation R may be translated through the rod string 18 in the well, without a need for the torque transfer device 72 and rotary actuator 74 to displace all the way from the rod's 50 upper stroke extent to its lower stroke extent. In such examples, the torque transfer device 72 and rotary actuator 74 may only displace with the rod 50 partially between its upper and lower stroke extents.

In some examples, the torque transfer device 72 may remain in gripping engagement with the rod 50 as the rod reciprocates upward and downward. In such examples, the control system 46 can operate the rotary actuator 74 to apply torque and rotation R to the rod 50 at or near its upper stroke extent. The control system 46 may operate the torque transfer device 72 to release its gripping engagement with the rod 50 only in certain situations, such as, for maintenance of the rod rotator 70, or to allow for adjustment of the rod's upper or lower stroke extent.

In some examples, the rotary actuator 74 may be operated to apply torque and rotation R to the rod 50 at positions other than, or in addition to, at or near the rod's upper stroke extent. For example, the rotary actuator 74 could apply torque and rotation R to the rod 50 at or near the rod's lower stroke extent, or during upward stroking of the rod. Thus, the scope of this disclosure is not limited to any particular position or displacement direction of the rod 50 when the rotary actuator 74 applies the torque and rotation R to the rod.

In some examples, a preselected torque and/or rotation may be initially applied to the rod 50, with the rotation remaining substantially the same during a particular stroke of the rod. In this case, it is expected that the initial applied torque will decrease during the stroke, due to the rod string 18 rotating in the well and thereby relieving the torque. In other examples, the applied torque could be maintained throughout the stroke, with the rotation increasing during the stroke. Thus, the scope of this disclosure is not limited to any particular relationship between a stroke of the rod 50 and the applied torque or rotation, or to whether the torque or rotation increases, decreases or remains constant during the stroke.

Figure 6:
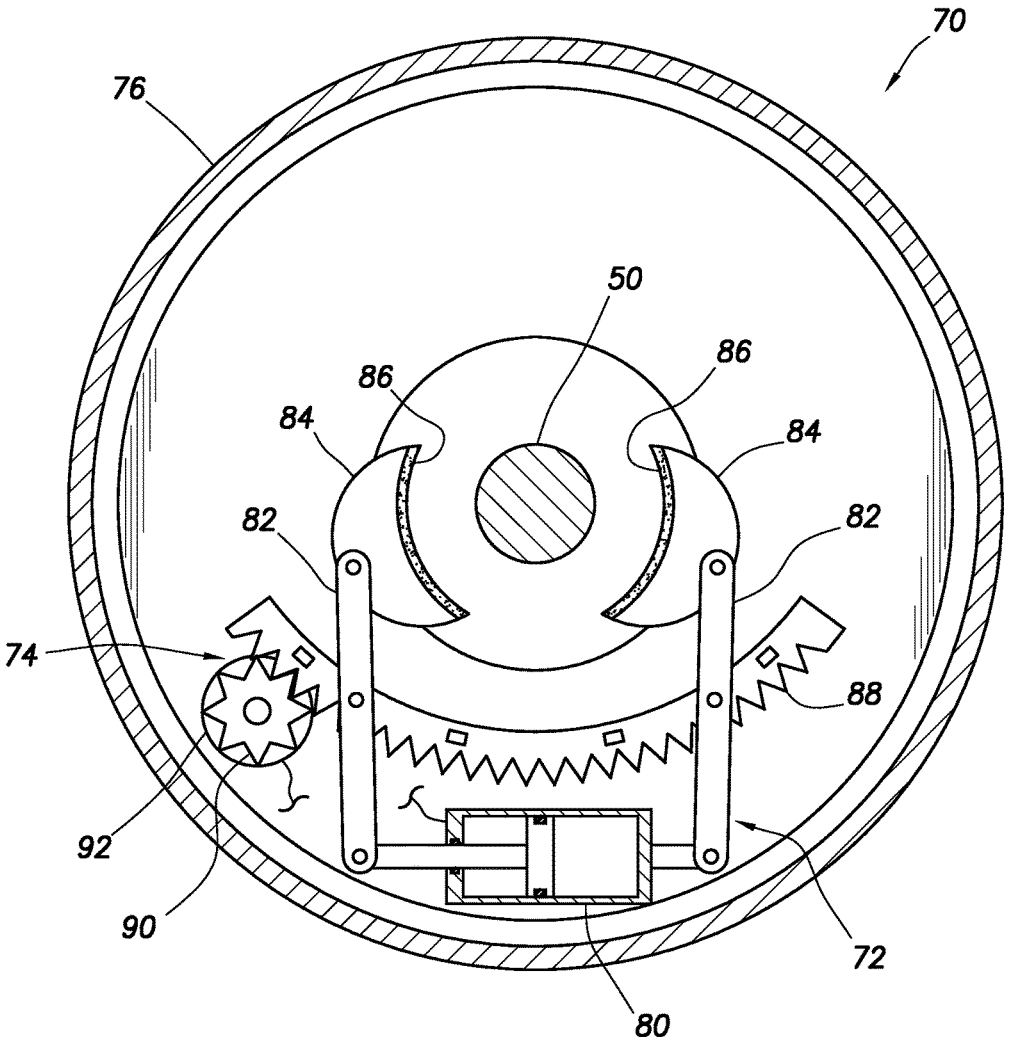
FIG. 6 is a representative partially cross-sectional view of another example of the rod rotator.

Referring additionally now to FIG. 6, a partially cross-sectional view of another example of the rod rotator 70 is representatively illustrated. In this example, the rod rotator 70 includes the torque transfer device 72 and the rotary actuator 74 fully enclosed within the outer housing 76 of the rod rotator.

One advantage of enclosing at least the moving components of the torque transfer device 72 and the rotary actuator 74 within the outer housing 76 is that the moving components are protected from damage. Another advantage is that personnel at the well site are not exposed to the moving components. However, the scope of this disclosure is not limited to fully enclosing the torque transfer device 72 and the rotary actuator 74 within the outer housing 76, or to enclosing any particular components of the torque transfer device and rotary actuator within the outer housing.

In the FIG. 6 example, the torque transfer device 72 includes a hydraulic cylinder 80 used to rotate lever arms 82 and thereby displace grips 84 into or out of gripping contact with the rod 50. Each of the grips 84 may be provided with, for example, a high friction gripping surface 86 to enhance rotation and torque transfer to the rod 50.

The hydraulic cylinder 80 is supplied with fluid pressure from a hydraulic pressure source (not shown in FIG. 6). In some examples, the fluid pressure could be supplied from the power source 12 (see FIG. 1). The control system 46 can control application and release of fluid pressure to/from the hydraulic cylinder 80 in coordination with the reciprocating displacement of the rod 50.

The hydraulic cylinder 80 may be a single-acting, double-acting or other type of hydraulic cylinder. In other examples, other types of actuators may be used instead of the hydraulic cylinder (such as, a pneumatic cylinder, a mechanical actuator/linkage, an electric linear actuator including a stepper motor, etc.). Thus, the scope of this disclosure is not limited to use of any particular type of actuator in the torque transfer device 72.

The rotary actuator 74 depicted in FIG. 6 includes a segment of a ring gear 88 engaged with a pinion gear 90 rotated by a motor 92. The ring gear 88 is connected to the torque transfer device 72, so that the torque transfer device can be rotated by corresponding rotation of the ring gear, in response to rotation of the pinion gear 90 by the motor 92. The control system 46 can control operation of the motor 92 in coordination with the reciprocating displacement of the rod 50.

The motor 92 may be an electrical stepper motor, a fluid-driven motor (such as, a hydraulic or pneumatic motor), or another type of motor. The ring gear 88 and pinion gear 90 may be substituted with appropriately configured worm gears or other types of motion-translating components. Therefore, it will be appreciated that the scope of this disclosure is not limited to use of any particular actuator or motion-translating components in the rotary actuator 74.

In operation of the FIG. 6 example, the torque transfer device 72 can grip the rod 50 at or near the beginning of an upward or downward stroke of the rod, and then the rotary actuator 74 can apply torque and rotation R to the rod 50. The torque and rotation R can be maintained by the torque transfer device 72 and rotary actuator 74 during the full upward or downward stroke, or only partially during the upward or downward stroke. The torque or rotation may increase, decrease or remain constant during the upward or downward stroke.

Figure 8:
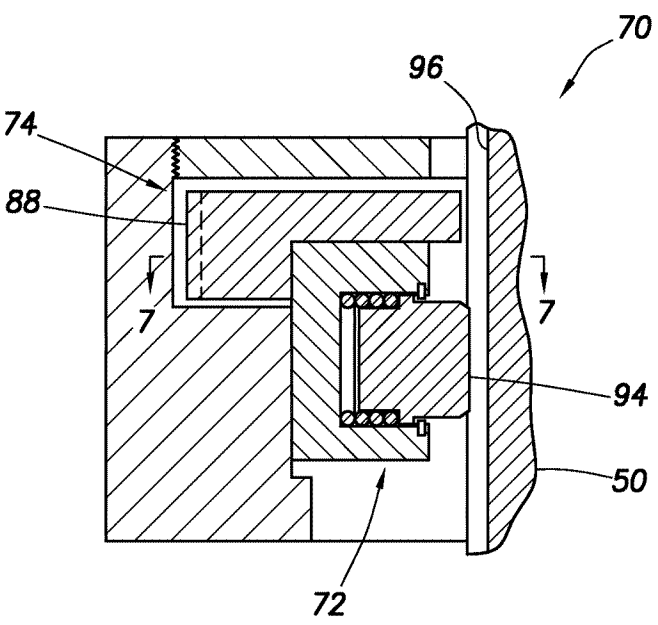
FIGS. 7 & 8 are representative cross-sectional views of another example of the rod rotator.
Figure 7:
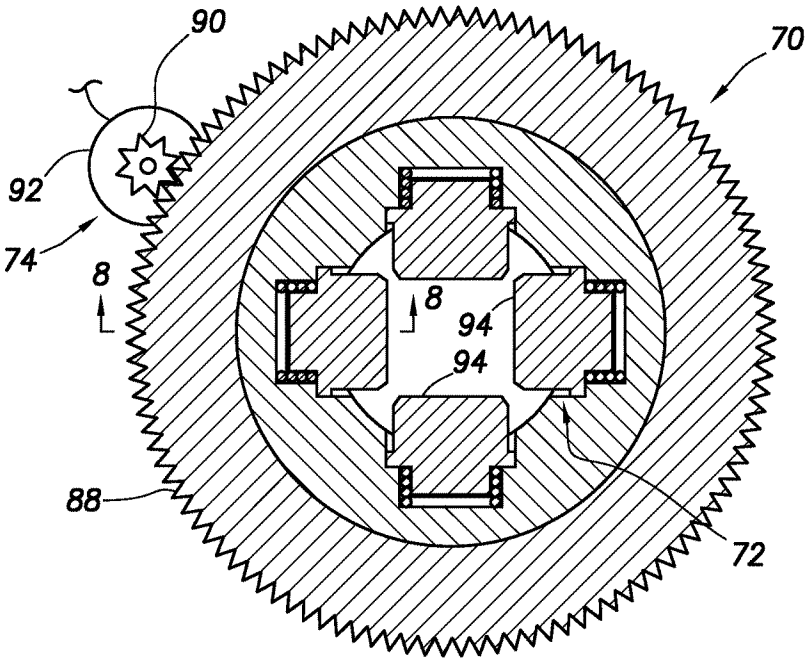

Referring additionally now to FIGS. 7 & 8, another example of the rod rotator 70 is representatively illustrated. For clarity of illustration, the outer housing 76 is not depicted in FIGS. 7 & 8, but it should be understood that the torque transfer device 72 and the rotary actuator 74 in this example are fully enclosed within the outer housing.

As depicted in FIG. 7, the ring gear 88 is not a segment, but makes a complete ring. In this manner, the rotary actuator 74 can continue to rotate the torque transfer device 72 during multiple upward and/or downward strokes of the rod 50, without reversing direction.

The torque transfer device 72 in this example includes multiple inwardly biased engagement members 94 that engage the rod 50 (not shown in FIG. 7 for clarity, see FIG. 8). The engagement members 94 may be provided with gripping surfaces 86 (as in the example of FIG. 5) for grippingly engaging an outer surface of the rod 50, but in the FIGS. 7 & 8 example, the engagement members are configured to slidingly engage slots 96 extending longitudinally on the rod 50.

The torque transfer device 72 and the rotary actuator 74 do not displace longitudinally with the rod 50 during its reciprocation. Instead, the torque transfer device 72 and the rotary actuator 74 remain in a same longitudinal position as the rod 50 strokes upward and downward.

The rotary actuator 74 rotates the ring gear 88 and the torque transfer device 72 (and the rod 50 engaged therewith) during the upward and/or downward strokes of the rod (and/or between the upward and downward strokes). The control system 46 can control the motor 92 and rotation of the ring gear 88 in coordination with the reciprocating displacement of the rod 50. The torque or rotation imparted to the rod 50 may increase, decrease or remain constant during the upward or downward stroke.

Figure 9:
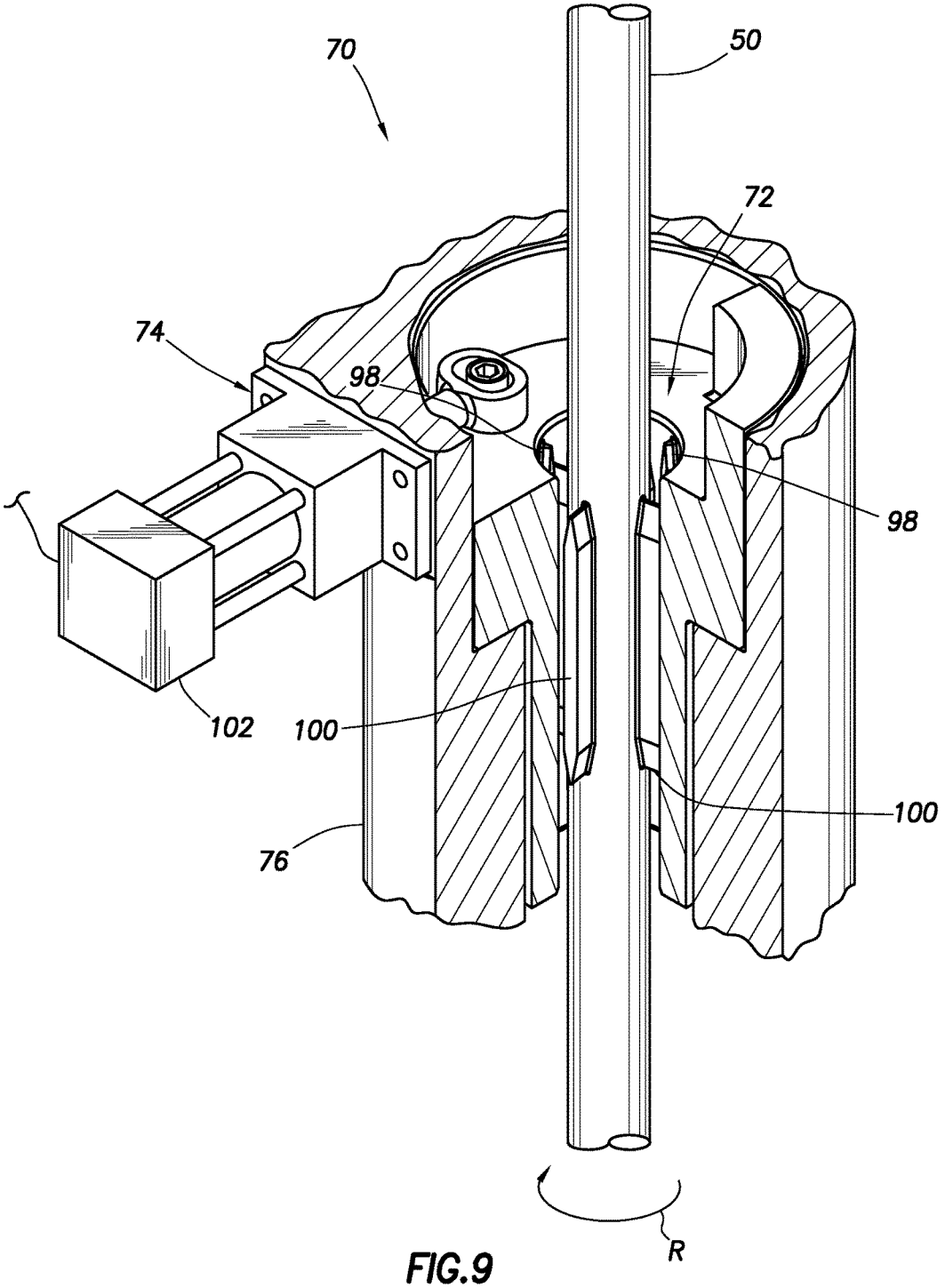
FIGS. 9-11 are representative cross-sectional views of yet another example of the rod rotator.
Figure 10:
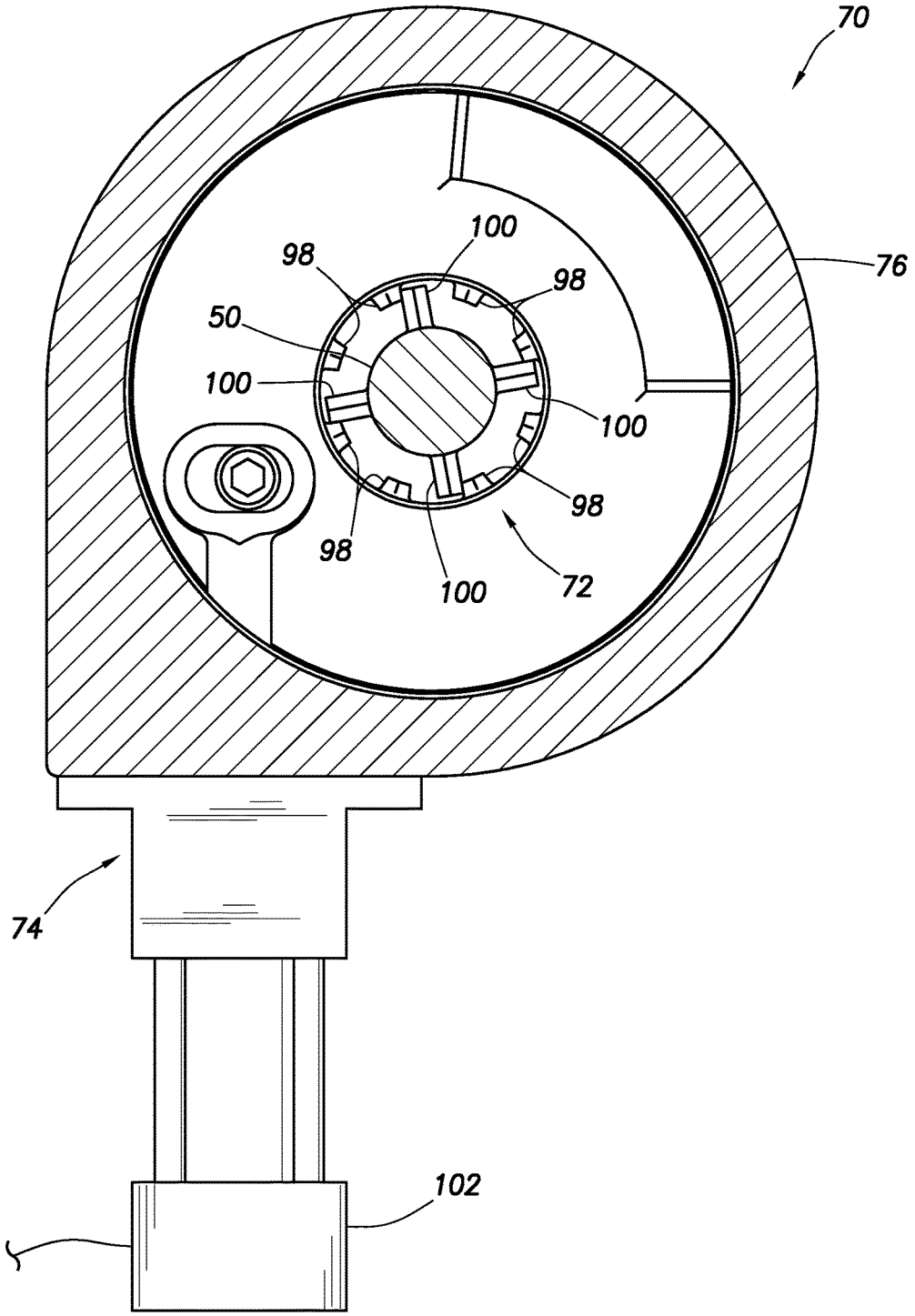
Figure 11:
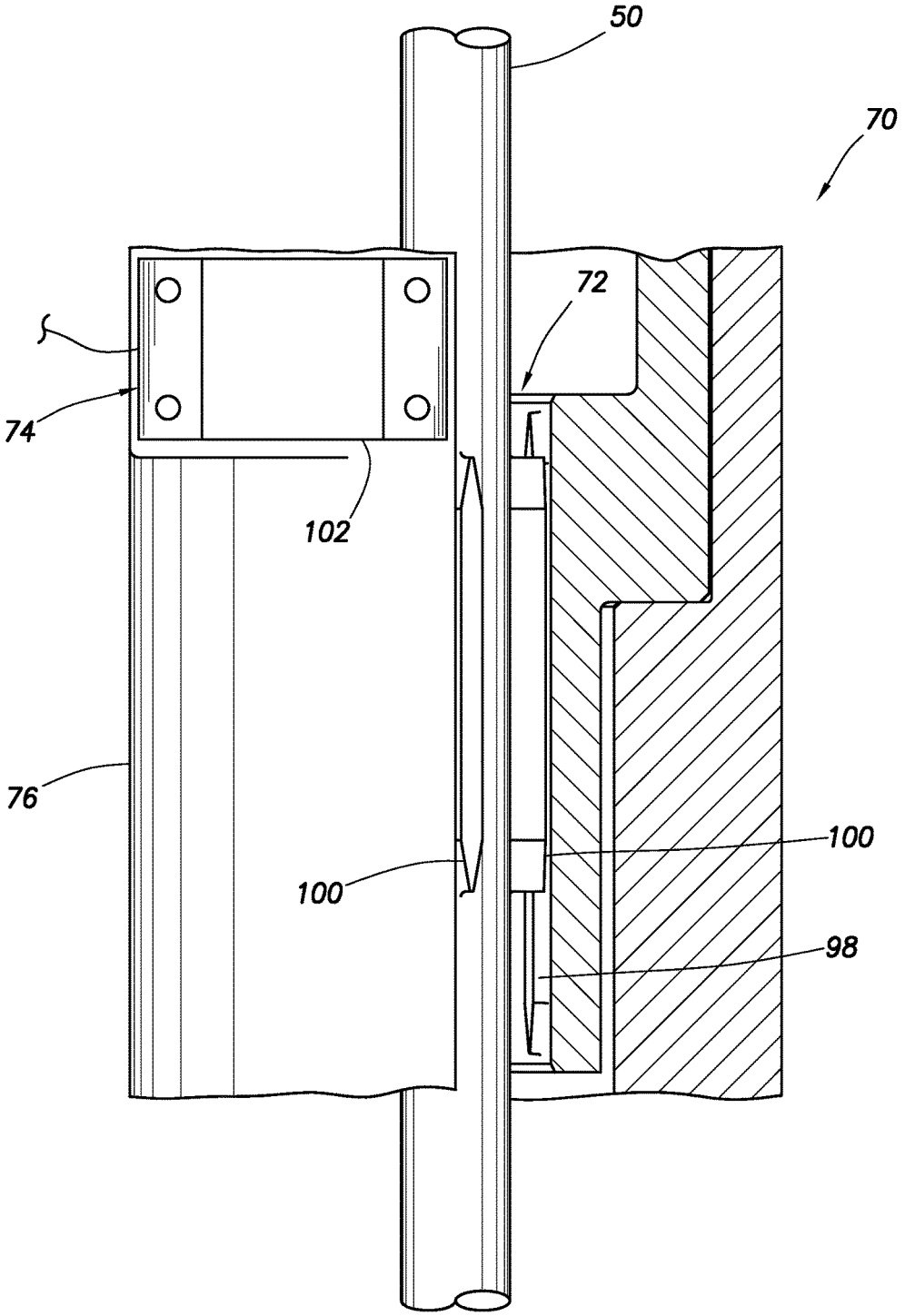

Referring additionally now to FIGS. 9-11, another example of the rod rotator 70 is representatively illustrated. In this example, the torque transfer device 72 and the rotary actuator 74 do not displace longitudinally with the rod 50, and the torque transfer device also does not remain engaged with the rod throughout its reciprocating displacement.

Instead, the torque transfer device 72 includes splines 98 that engage splines 100 on the rod 50 only during a part of the rod's upward and downward displacement. When the splines 98, 100 are engaged, the rotary actuator 74 is operated by the control system 46 to rotate the torque transfer device 72, and thereby transmit torque and rotation R to the rod 50.

When the rod 50 displaces a certain distance upward or downward, the splines 98, 100 become longitudinally separated and disengage, and the rotary actuator 74 is operated by the control system 46 to rotate the torque transfer device 72 back to its initial rotational position. Displacement of the rod 50 back to its initial longitudinal position then engages the splines 98, 100 again, and this process repeats. The torque or rotation imparted to the rod 50 may increase, decrease or remain constant during the upward or downward stroke, while the splines 98, 100 are engaged.

Preferably, the splines 98, 100 remain engaged long enough for the rod string 18 to rotate in the well in response to the torque and rotation R imparted to the rod 50 in the rod rotator 70. However, it is not necessary for all of the rotation imparted to the rod 50 in the rod rotator 70 to be fully transmitted along the rod string 18 in the well, since the splines 98, 100 can re-engage, no matter a rotational orientation of the rod 50 relative to the torque transfer device 72.

The rotary actuator 74 in this example includes a hydraulic cylinder 102 for rotating the torque transfer device 72 in the outer housing 76 of the rod rotator 70. The hydraulic cylinder 102 is supplied with fluid pressure from a hydraulic pressure source (not shown in FIGS. 9-11). In some examples, the fluid pressure could be supplied from the power source 12 (see FIG. 1). The control system 46 can control application and release of fluid pressure to/from the hydraulic cylinder 102 in coordination with the reciprocating displacement of the rod 50.

The hydraulic cylinder 102 may be a single-acting, double-acting or other type of hydraulic cylinder. In other examples, other types of actuators may be used instead of the hydraulic cylinder (such as, a pneumatic cylinder, a mechanical actuator/linkage, an electric linear actuator including a stepper motor, etc.). Thus, the scope of this disclosure is not limited to use of any particular type of actuator in the rotary actuator 74.

Note that it is not necessary in any of the examples of FIGS. 1-11 for the continuous position sensor 52 to be used, or for the control system 46 to be used for controlling operation of the rod rotator 70. In other examples, the rod rotator 70 operation could be controlled by mechanical or electro-mechanical devices (e.g., limit switches, cams, linkages, etc.).

It may now be fully appreciated that the above disclosure provides significant advancements to the arts of monitoring and controlling operation of a well pumping system. In examples described above, the rod rotator 50 rotates the rod string 18 in the well, and is at least partially enclosed (such as, in the outer housing 76 connected between the stuffing box 44 and the blowout preventer stack 42).

The above disclosure provides to the art a well pumping system 10. In one example, the well pumping system 10 can include a rod rotator 70 including a torque transfer device 72, an outer housing 76 and a rotary actuator 74. The rotary actuator 74 rotates the torque transfer device 72 and a rod 50 relative to the outer housing 76. The rod 50 reciprocably displaces longitudinally relative to the outer housing 76.

The outer housing 76 may be connected between a stuffing box 44 and a blowout preventer 42. The torque transfer device 72 may be fully enclosed within the outer housing 76.

The rod rotator 70 may apply a torque to the rod 50 while the rod displaces. The rod rotator 70 may maintain a torque applied to the rod 50 while the rod displaces.

The system 10 can include a control system 46 that controls operation of the rod rotator 70. The control system 46 may receive an output of a continuous position sensor 52.

The control system 46 may control operation of an actuator 14 that reciprocably displaces the rod 50. The control system 46 may control operation of the rotary actuator 74 and/or the torque transfer device 72.

A method of rotating a rod string 18 in a subterranean well is also provided to the art by the above disclosure. In one example, the method comprises: applying a torque from a torque transfer device 72 to a rod 50 connected to the rod string 18, the torque being maintained in the rod 50 as the rod displaces relative to an outer housing 76. The torque transfer device 72 is fully enclosed within the outer housing 76 during the torque applying step.

The method may include connecting the outer housing 76 between a stuffing box 44 and a blowout preventer 42.

The torque transfer device 72 and the outer housing 76 are included in a rod rotator 70. A control system 46 may control operation of the rod rotator 70.

Another well pumping system 10 for use with a subterranean well is described above. In this example, a rod rotator 70 includes an outer housing 76 connected between a stuffing box 44 and a blowout preventer 42. The rod rotator 70 rotates a rod string 18 in the well.

The rod rotator 70 may apply a torque to the rod string 18 while the rod string displaces. The rod rotator 70 may maintain a torque applied to the rod string 18 while the rod string displaces. The rod rotator 70 may apply a torque to a rod 50 that displaces longitudinally relative to the outer housing 76.

The rod rotator 18 can include a torque transfer device 72. The torque transfer device 72 may be fully enclosed within the outer housing 76.

The rod rotator 18 can include a rotary actuator 74 and a torque transfer device 72. The rotary actuator 74 may rotate the torque transfer device 72 relative to the outer housing 76.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "raised," "lowered," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well pumping system, comprising:

a rod rotator including a torque transfer device, an outer housing and a rotary actuator, wherein the rotary actuator rotates the torque transfer device and a rod relative to the outer housing, and wherein the rod reciprocably displaces longitudinally relative to the outer housing; and a control system, wherein the control system controls operation of the rod rotator based on an output of a continuous position sensor which continuously detects a longitudinal position of the rod as the rod reciprocates.

2. The system of claim 1, wherein the rod rotator is connected between a stuffing box and a blowout preventer.

3. The system of claim 1, wherein the rod rotator applies a torque to the rod while the rod displaces.

4. The system of claim 1, wherein the rod rotator maintains a torque applied to the rod while the rod displaces.

5. The system of claim 1, wherein the torque transfer device is fully enclosed within the outer housing.

6. The system of claim 1, wherein the control system also controls operation of an actuator that reciprocably displaces the rod.

7. The system of claim 1, wherein the control system controls operation of the rotary actuator.

8. The system of claim 1, wherein the control system controls operation of the torque transfer device.

9. A method of rotating a rod string, the method comprising:

applying a torque from a torque transfer device to a rod connected to the rod string, the torque being maintained in the rod as the rod displaces relative to an outer housing, wherein the torque transfer device is fully enclosed within the outer housing during the torque applying; and a control system controlling application of the torque based on an output of a continuous position sensor which detects a longitudinal position of the rod as the rod reciprocates.

10. The method of claim 9, wherein the torque transfer device and the outer housing are included in a rod rotator.

11. The method of claim 10, further comprising connecting the rod rotator between a stuffing box and a blowout preventer.

12. The method of claim 10, wherein the control system controls operation of a rotary actuator of the rod rotator.

13. The method of claim 9, wherein the control system also controls operation of an actuator that reciprocably displaces the rod.

14. The method of claim 9, wherein the control system controls operation of the torque transfer device.

15. A well pumping system for use with a subterranean well, comprising:

a rod rotator including an outer housing, wherein the rod rotator is connected between a stuffing box and a blowout preventer, and wherein the rod rotator rotates a rod string in the well.

16. The system of claim 15, wherein the rod rotator applies a torque to the rod string while the rod string displaces.

17. The system of claim 15, wherein the rod rotator maintains a torque applied to the rod string while the rod string displaces.

18. The system of claim 15, wherein the rod rotator includes a torque transfer device, and wherein the torque transfer device is fully enclosed within the outer housing.

19. The system of claim 15, wherein the rod rotator includes a rotary actuator and a torque transfer device, and wherein the rotary actuator rotates the torque transfer device relative to the outer housing.

20. The system of claim 15, further comprising a control system, and wherein the control system controls operation of the rod rotator.

21. The system of claim 20, wherein the control system receives an output of a continuous position sensor.

22. The system of claim 20, wherein the control system also controls operation of an actuator that reciprocably displaces the rod string.

23. The system of claim 20, wherein the control system controls operation of a rotary actuator of the rod rotator.

24. The system of claim 20, wherein the control system controls operation of a torque transfer device of the rod rotator.

25. The system of claim 15, wherein the rod rotator applies a torque to a rod that displaces longitudinally relative to the outer housing.

* * * * *